US010539087B2

(12) United States Patent
Brahma et al.

(10) Patent No.: US 10,539,087 B2
(45) Date of Patent: Jan. 21, 2020

(54) AIR-FUEL RATIO IMBALANCE DIAGNOSTIC USING EXHAUST MANIFOLD PRESSURE

(71) Applicant: Cummins Inc., Columbus, IN (US)

(72) Inventors: Avra Brahma, Fishers, IN (US); Yongsoon Yoon, Indianapolis, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/136,680

(22) Filed: Sep. 20, 2018

(65) Prior Publication Data

US 2019/0085782 A1 Mar. 21, 2019

Related U.S. Application Data

(60) Provisional application No. 62/560,870, filed on Sep. 20, 2017.

(51) Int. Cl.

| | |
|---|---|
| ***F02D 41/14*** | (2006.01) |
| ***F02D 41/00*** | (2006.01) |
| ***F02D 41/22*** | (2006.01) |
| *F02D 41/28* | (2006.01) |

(52) U.S. Cl.

CPC ..... *F02D 41/1454* (2013.01); *F02D 41/0085* (2013.01); *F02D 41/1448* (2013.01); *F02D 41/22* (2013.01); *F02D 41/0007* (2013.01); *F02D 41/0072* (2013.01); *F02D 2041/288* (2013.01); *F02D 2200/0402* (2013.01)

(58) Field of Classification Search

CPC .. F02D 41/14; F02D 41/1454; F02D 41/0085; F02D 41/1448; F02D 41/22; F02D 41/0007; F02D 41/0072; F02D 41/288; F02D 2200/0402

See application file for complete search history.

(56) References Cited

U.S. PATENT DOCUMENTS

| | | | | |
|---|---|---|---|---|
| 4,269,156 | A | 5/1981 | Drellishak | |
| 4,424,709 | A | 1/1984 | Meier, Jr. et al. | |
| 7,117,078 | B1 | 10/2006 | Gangopadhyay | |
| 9,650,977 | B2 * | 5/2017 | Martin | F02D 41/0085 |

* cited by examiner

*Primary Examiner* — Hieu T Vo

(74) *Attorney, Agent, or Firm* — Taft Stettinius & Hollister LLP

(57) ABSTRACT

One embodiment is a method comprising operating an internal combustion engine system including multiple cylinders structured to combust a charge mixture and to output exhaust to an exhaust manifold, an electronic control system structured to control operation of the engine system and an exhaust manifold pressure (EMP) sensor structured to provide data to the electronic control system and performing an air-fuel ratio (AFR) imbalance diagnostic with the electronic control system. The AFR imbalance diagnostic may comprise the acts of processing the data to provide at least one output metric sample, determining an output metric statistic based on the at least one output metric sample, evaluating the output metric statistic relative to one or more predetermined criteria to identify an AFR imbalance condition, and providing an operator perceptible indication of the AFR imbalance condition.

20 Claims, 12 Drawing Sheets

710

720

810

820

AIR-FUEL RATIO IMBALANCE DIAGNOSTIC USING EXHAUST MANIFOLD PRESSURE

BACKGROUND

The present disclosure relates generally to apparatuses, methods, systems, and techniques for air-fuel ratio (AFR) imbalance diagnostics. While not so limited, the disclosure finds particular application in the context of spark-ignited engines, such as those fueled by liquid fuels such as gasoline and ethanol and/or gaseous fuels such as natural gas, including pipeline gas, wellhead gas, producer gas, field gas, nominally treated field gas, well gas, nominally treated well gas, bio-gas, methane, ethane, propane, butane, liquefied natural gas (LNG), compressed natural gas, landfill gas, condensate or coal-bed methane (CBM). Such systems frequently utilize an exhaust aftertreatment catalyst whose operation can deteriorate if a cylinder-to-cylinder AFR imbalance is present in the engine, posing a longstanding problem in the art. For example, such systems often utilize a three-way catalyst whose operation deteriorates significantly if an AFR imbalance is present between cylinders, a condition which may be referred to as an inter-cylinder AFR imbalance. Some diagnostics to detect the presence of AFR imbalance have been proposed; however, there remain shortcomings in the performance, reliability, and robustness of conventional approaches. There remains a substantial need for the unique apparatuses, methods, systems, and techniques disclosed herein.

DISCLOSURE OF ILLUSTRATIVE EMBODIMENTS

For the purposes of clearly, concisely and exactly describing illustrative embodiments of the present disclosure, the manner, and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created and that the invention includes and protects such alterations, modifications, and further applications of the exemplary embodiments as would occur to one skilled in the art.

BRIEF SUMMARY OF THE DISCLOSURE

One embodiment is a unique diagnostic technique to identify an air-fuel ratio (AFR) imbalance in an internal combustion engine. Other embodiments include unique apparatuses, methods, and systems operable to identify an AFR imbalance in an internal combustion engine. Further embodiments, forms, objects, features, advantages, aspects, and benefits shall become apparent from the following description and drawings.

DETAILED DESCRIPTION OF ILLUSTRATIVE EMBODIMENTS

Figure 1:
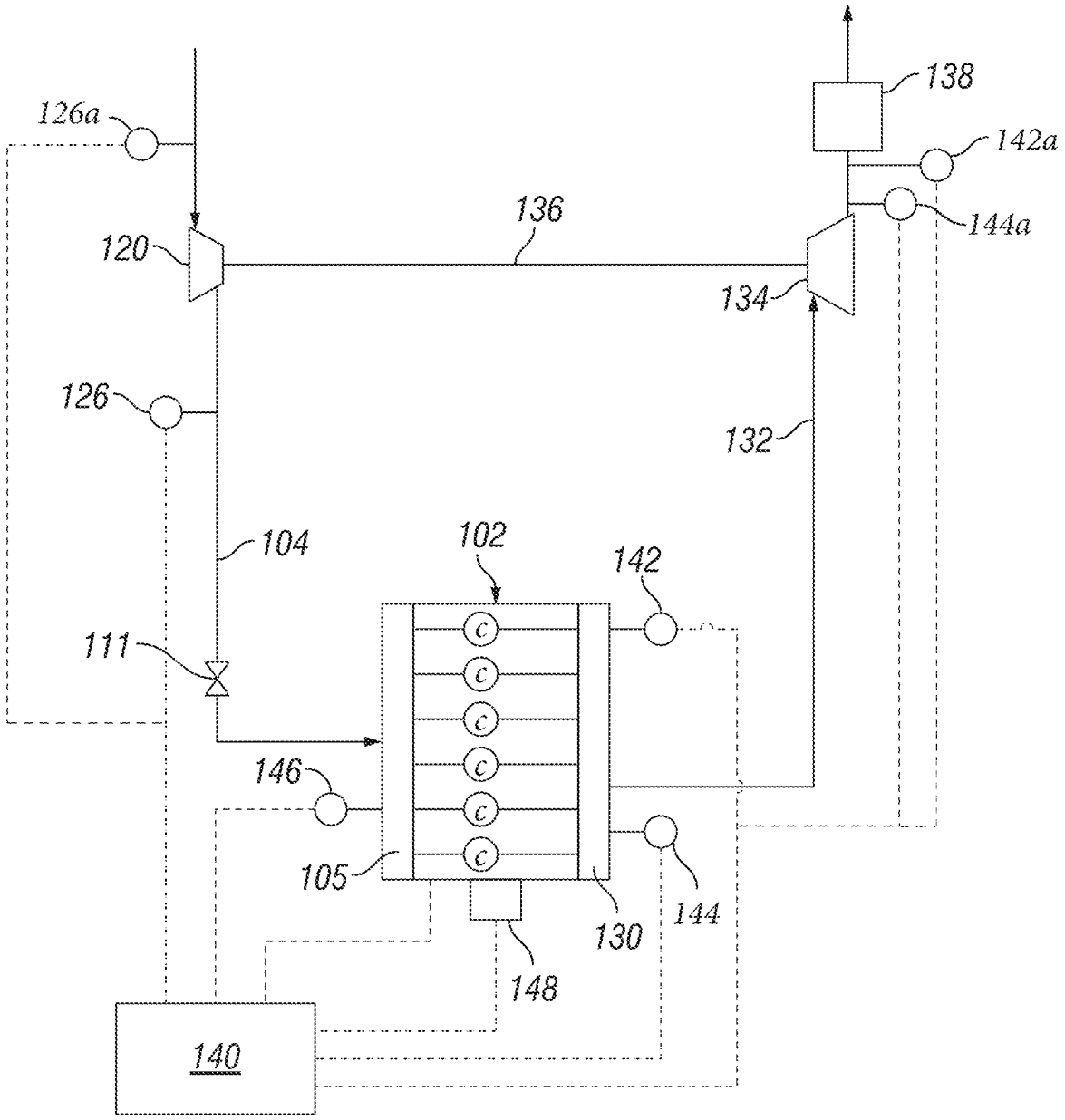
FIG. 1 is a schematic illustration of an exemplary system including an internal combustion engine.

With reference to FIG. 1, there is illustrated a schematic depiction of certain aspects of an exemplary system 100 including an engine 102. The engine 102 is an internal combustion engine and is preferably a spark ignition engine such as a spark ignition natural gas or spark ignition gasoline engine. The engine 102 includes a number of cylinders "c" which are depicted in an inline 6-cylinder arrangement for illustration of but one embodiment, it being understood that a variety of different numbers and configurations of cylinders are contemplated. The number of cylinders may be any number suitable for an engine, and the arrangement may be any suitable arrangement. The example engine 102 further includes an ignition source for each cylinder "c" such as a spark plug.

In certain embodiments, the engine 102 is provided as a spark-ignition internal combustion engine, configured to develop mechanical power from internal combustion of a stoichiometric mixture of fuel and induction gas. As used herein, the phrase "induction gas" may include fresh air, recirculated exhaust gases, or the like, or any combination thereof. The phrase "charge mixture" includes induction gas and may also include fuel, such as natural gas or gasoline which may be mixed with or injected into the induction gas. An intake manifold 105 receives charge mixture including induction gas which passes through an intake passage 104 and is compressed by a compressor 120 of a turbocharger 136. An intake throttle 111 may be provided to regulate the charge flow through the intake passage 104. The intake passage 104 distributes the induction gas to the intake manifold 105 combustion chambers of cylinders "c" of the engine 102. Accordingly, an inlet of the intake manifold 105 is disposed downstream of an outlet of the intake passage 104, and an outlet of the intake manifold 105 is disposed upstream of an inlet of each of the combustion chambers in engine 102.

During operation of the engine 102, each of the cylinders "c" operates by combusting fuel in response to a fueling command and spark/ignition timing to produce a torque output to satisfy a torque request or torque demand. Under certain operating conditions, the induction gas properties, amounts, constituents, etc. vary from one cylinder to the next. For example, the engine 102 may experience an air-fuel ratio (AFR) imbalance condition in one or more cylinders. As utilized herein the term "air-fuel ratio" refers inclusively to a number of expressions of the proportion of intake air and fuel in the charge mixture received by the cylinders "c" of the engine 102. In embodiments which include an exhaust gas recirculation (EGR) system, to these expressions may account for the proportion of induction gas inclusive of any EGR which may be present, and fuel in the charge mixture received by the cylinders "c" of the engine 102. Exemplary expressions of air-fuel ratio include the literal ratio of air to fuel which may both be expressed in units of mass, the ratio of air to fuel normalized by the stoichiometric ratio of air to fuel which is sometimes referred to as "lambda" and may be denoted as "$\lambda$", the literal ratio of fuel to air which may both be expressed in units of mass, the equivalence ratio which is the fuel to air ratio normalized by the stoichiometric fuel to air ratio and which is sometimes referred to as "phi" and may be denoted as "ϕ", and various other expressions which correlate with the ratio of air and fuel in the charge mixture received by the cylinders "c" of the engine 102.

Engine 102 is provided with an electronic control system 140 configured to perform a diagnostic to identify an AFR imbalance condition. In certain forms the electronic control system may be configured to process data received by an exhaust manifold pressure (EMP) sensor, for example, EMP sensor 144, EMP sensor 144*a* or an EMP sensor provided in an alternate configuration and/or location in system 100, to provide at least one output metric sample. As understood by a person of skill in the art an output metric sample is a sampling of the raw data output by a sensor. Examples of output metric samples include storing discretized sample values at various sampling rates or frequencies, reconstructing sample values of continuous function from samples by use of an interpolation algorithm, and mapping or transforming sample values to various data structures to name several examples.

The electronic control system may be further configured to compute an output metric statistic based on the at least one output metric sample. As understood by a person of skill in the art an output metric statistic is a value or set of values resulting from statistical processing such statistical processing effective to provide any of the various particular output metric statistics illustrated in and described herein. It shall be appreciated that, while an output metric statistic may comprise a variety of measures of an attribute of a sample which are calculated by applying a statistical algorithm or function to a plurality of sample values, an output metric statistic can be distinguished from a raw input value, an individual sample value, and/or a processed value which is not calculated by applying a statistical algorithm or function to a plurality of sample values.

The electronic control system may be further configured to evaluate the output metric statistic relative to one or more predetermined criteria to identify an AFR imbalance condition. The electronic control system may be further configured to perform a corrective control operation modifying the operation of the system in which the electronic control system is implemented. Such corrective control operations may include one or more of constraining, derating, limiting or modifying engine operation, entering into a limp home mode, and providing an operator perceptible indication of the AFR imbalance condition such activating a malfunction indicator lamp (MIL), or check engine light.

An exhaust manifold 130 collects exhaust gases from the cylinders "c" of the engine 102 and conveys the exhaust gases to the exhaust passage 132. Accordingly, inlets of the exhaust manifold 130 are disposed downstream of an outlet of each of the cylinders "c" in engine 102, and upstream of inlets to an exhaust passage 132.

The engine 102 includes a fuel delivery system (not illustrated) that is structured to deliver fuel to the intake passage 104 of the engine 102. The fuel delivery system can include, for example, a fuel tank, a fuel pump and an injector that are configured and operable to deliver a liquid fuel such as gasoline to the intake passage 104 or the intake manifold 105 and ultimately to the cylinders "c" of the engine 102. In other forms, the fuel delivery system can include, for example, a fuel tank, a fuel control valve and a mixer that are configured and operable to provide a gaseous fuel such as natural gas to the intake passage 104 or the intake manifold 105 and ultimately to the cylinders "c" of the engine 102. In further forms, the fuel delivery system may include one or more direct injectors configured to inject fuel directly into the cylinders "c" of the engine 102 so the fuel may be combusted within a combustion chamber of the respective cylinder "c" by a spark from a spark plug.

An exhaust passage 132 is configured to receive exhaust output from the cylinders "c" to the exhaust manifold 130. The exhaust passage 132 routes exhaust to a turbine 134 of the turbocharger 136. The turbine 134 is coupled with the compressor 120 and is operable to drive the compressor 120 through expansion of exhaust gasses across the turbine 134. The turbine 134 can be a variable geometry turbine with an adjustable inlet or outlet, or may include a wastegate to bypass exhaust flow. It shall be further appreciated that the turbocharger may be provided in any other suitable manner (e.g., as a multi-stage turbocharger, or the like), and may be provided with or without a wastegate and/or bypass. Other embodiments contemplate an exhaust throttle (not shown) provided in the exhaust passage 132.

The exhaust passage 132 further includes an exhaust aftertreatment complement 138, such as a three-way catalyst, that is configured to treat emissions in the exhaust gas. Aftertreatment system 138 can include a variety of other aftertreatment components known in the art. Example aftertreatment components treat carbon monoxide (CO), unburned hydrocarbons (HC), nitrogen oxides ($NO_x$), volatile organic compounds (VOC), and/or particulate matter (PM). While not depicted in the illustrated embodiment, it is contemplated that the engine 102 may include an EGR system structured to recirculate exhaust received from the cylinders "c" of the engine 102 to the intake of engine 102. The EGR system may be structured as a high-pressure loop EGR system, a low-pressure loop EGR system or combinations thereof.

The electronic control system 140 forms a portion of a processing subsystem including one or more determining devices having memory, processing, and communication hardware. The electronic control system 140 may include one or more microprocessor-based or microcontroller-based electronic control units (ECU). The electronic control system 140 may be a single device or a distributed device, and the functions of the electronic control system 140 may be performed by hardware or software. The electronic control system 140 may be included within, partially included within, or completely separated from an engine controller (not shown).

The electronic control system 140 is in communication with a number sensor or actuator throughout the system 100, including through direct communication, communication over a datalink, and/or through communication with other controllers or portions of the processing subsystem that provide sensor and/or actuator information to the electronic control system 140. In the illustrated embodiment, electronic control system 140 is connected an intake air flow sensor 126 or 126*a*, fuel system, exhaust oxygen sensor or lambda sensor 142 or 142*a*, exhaust manifold pressure (EMP) sensor 144 or 144*a*, and intake manifold pressure (IMP) sensor 146, and engine speed sensor 148 which may be a crankshaft position sensor or another type of engine speed sensor. Electronic control system 140 may be in communication with a number of additional sensors which have not been illustrated in the interest of clarity including, for example, an intake manifold temperature sensor, an exhaust manifold temperature sensor, an O2 sensor, and a variety of other sensors operable to provide an output indicative of an engine operating parameter. The sensors discussed herein may be real or virtual sensors and may provide outputs derived from one or more inputs. It shall be appreciated that various other configurations and locations for the foregoing sensors are contemplated in additional embodiments as would occur to one of skill in the art with the benefit of the present disclosure. As non-limiting examples, intake air flow sensor 126*a* illustrates an alternate configuration and location of an intake air flow sensor, exhaust oxygen sensor or lambda sensor 142*a* illustrates an alternate configuration and location of an exhaust oxygen sensor or lambda sensor, and EMP sensor 144*a* illustrates an alternate configuration and location of an exhaust manifold pressure sensor.

Example and non-limiting controller implementation elements include sensors as discussed above providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), and/or digital control elements.

The listing herein of specific implementation elements is not limiting, and any implementation element for any controller described herein that would be understood by one of skill in the art is contemplated herein. The controllers herein, once the operations are described, are capable of numerous hardware and/or computer-based implementations, many of the specific implementations of which involve mechanical steps for one of skill in the art having the benefit of the disclosures herein and the understanding of the operations of the controllers provided by the present disclosure.

Certain operations described herein include operations to determine one or more values or parameters. As utilized herein, the term determining includes a number of operations which may be performed by on in connection with elements of an electronic control system to provide an output value including calculation, computation, estimation, heuristic selection and combinations of these with one another or other exemplary techniques. It shall further be appreciated that the term determining also includes receiving values by any method, including at least receiving values from a datalink or network communication, receiving an electronic signal (e.g. a voltage, frequency, current, or PWM signal) indicative of the value, receiving a software parameter indicative of the value, reading the value from a memory location on a non-transient computer-readable storage medium, receiving the value as a run-time parameter by any means that would occur to a person of skill in the art, and/or by receiving a value by which the interpreted parameter can be determined, and/or by referencing a default value that is interpreted to be the parameter value.

In certain embodiments, the electronic control system 140 provides an engine control command, and one or more components of the engine system 100 are responsive to the engine control command. The engine control command, in certain embodiments, includes one or more messages, and/or includes one or more parameters structured to provide instructions to the various engine components responsive to the engine control command. An engine component responding to the engine control command may follow the command, receive the command as a competing instruction with other command inputs, utilize the command as a target value or a limit value, and/or progress in a controlled manner toward a response consistent with the engine control command.

Figure 2:
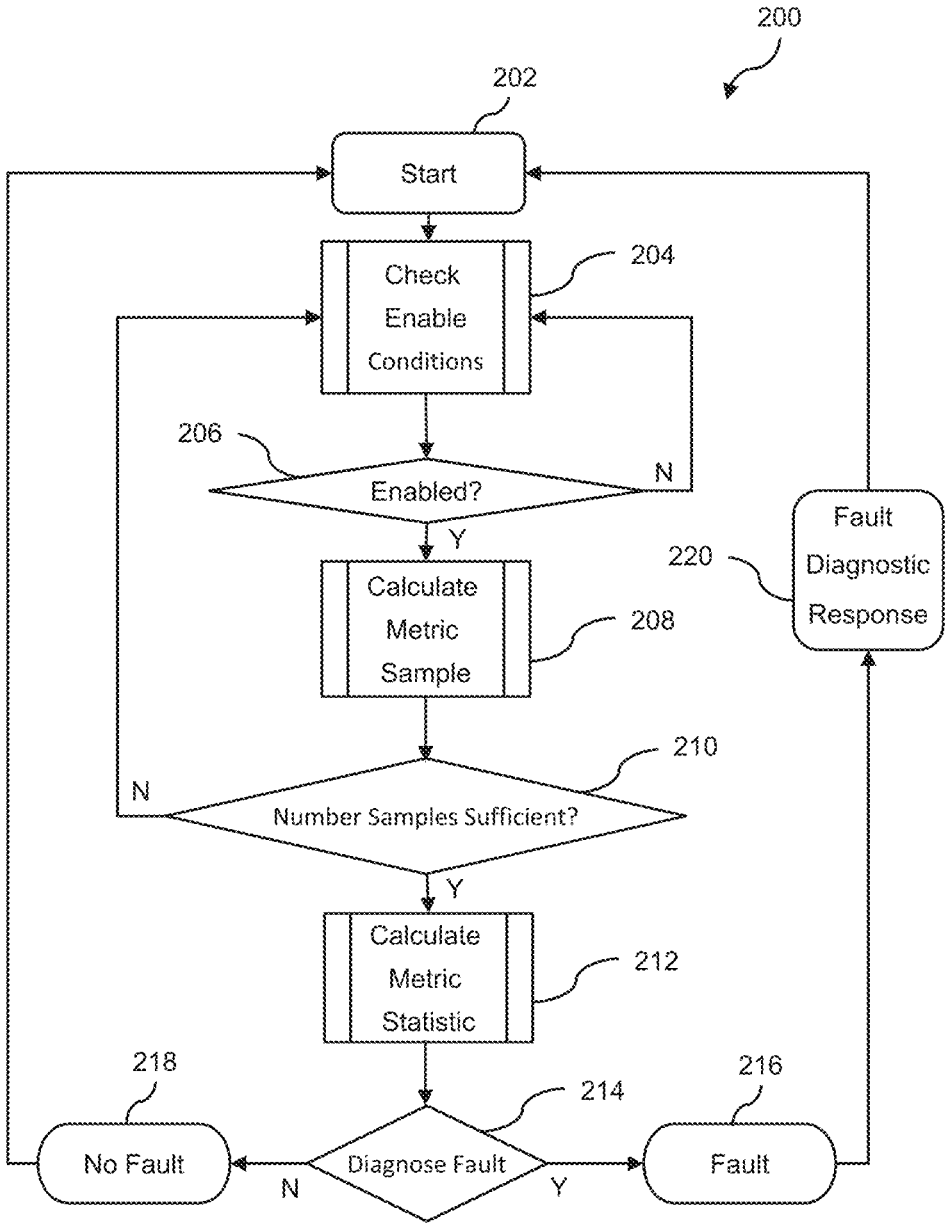
FIG. 2 is a flowchart illustrating an exemplary diagnostic process which may be utilized by a system such as the exemplary system of FIG. 1.

With reference to FIG. 2, there is illustrated a flowchart depicting an exemplary diagnostic process 200 (sometimes referred to herein as process 200) which may be performed by the electronic control system 140 described above in connection with FIG. 1 or other electronic control systems provided in connection with an internal combustion engine. Process 200 begins at start operation 202. From start operation 202, process 200 proceeds to operation 204 which initiates a check to determine whether one or more enable conditions are satisfied and stores the present values of the one or more enable conditions in a non-transitory memory medium of the electronic control system 140. The enable conditions may include an indication of the health or operational state of the exhaust manifold pressure (EMP) sensor 144. From operation 204, process 200 proceeds to conditional 206 which evaluates the present values of the one or more inputs to the enablement conditions relative to one or more respective criteria. If conditional 206 evaluates that the enable conditions are not satisfied, process 200 returns to operation 204. On the other hand, if conditional 206 evaluates that the enable conditions are satisfied, process 200 proceeds to operation 208.

Operation 208 determines a metric sample based on information received from or provided by the exhaust manifold the EMP sensor 144 by processing this information to provide at least one output metric sample. A number of different metrics may be utilized in connection with process 200. For example, metrics pertaining to the frequency content of an EMP sensor, metrics pertaining to a combination of the output of an EMP sensor and an exhaust oxygen sensor, and metrics pertaining to a uniformity characteristic derived from the output of an EMP sensor may be utilized individually or in combination with one another or other metrics. Further aspects of exemplary metrics which may be utilized in connection with process 200 are illustrated and described in connection with FIGS. 3-11.

From operation 208, process 200 proceeds to conditional 210 which evaluates whether a sufficient number of output metric samples have been obtained. If conditional 210 evaluates that a sufficient number of output metric samples have not been obtained, process 200 returns to operation 204. On the other hand, if conditional 210 evaluates that a sufficient number of output metric samples have been obtained, process 200 proceeds to operation 212.

Operation 212 determines a metric statistic based on the at least one metric sample. A number of different statistics may be utilized in connection with process 200. For example, statistics of distributions of metrics pertaining to the frequency content of the EMP sensor, statistics of distributions of metrics pertaining to a combination of the output and the EMP sensor and an engine oxygen sensor, and statistics of distributions of metrics pertaining to a uniformity characteristic derived from output of the EMP sensor may be utilized individually or in combination with one another statistical techniques. Further aspects of exemplary statistical techniques which may be utilized in connection with process 200 are illustrated and described in connection with FIGS. 3-11.

From operation 212, process 200 proceeds to conditional 214 which evaluates whether to diagnose a fault based on one or more output metric statistics determined in connection with operation 212. Conditional 214 may utilize a number of techniques or criteria including simple thresholds, compound thresholds, thresholds with hysteresis, timed thresholds, counted thresholds and other techniques effective to evaluate one or more metric statistics determined by operation 212 and to identify presence or absence of a fault condition based upon this evaluation. If conditional 214 determines that no fault condition is present, process 200 proceeds to operation 218 which sets a no fault condition and then returns to operation 202 or may end and may be re-executed at a later point of operation. On the other hand, if conditional 214 determines that a fault condition is present, process 200 proceeds to operation 218 which sets a fault condition. From operation 218, process 200 proceeds to operation 220 which performs a fault diagnostic response operation also referred to herein as a corrective control operation. The fault diagnostic response operation may comprise a number of control system responses. In one aspect the fault diagnostic response operation may perform one or more operations to modify operation or control of the engine including. For example, the fault diagnostic response operation may derate the engine, enter a limp home mode, or otherwise impose or reduce the magnitude of constraints on engine operation such as engine speed or engine torque. In another aspect the fault diagnostic response operation may provide an operator perceptible output indicating the fault, for example, displaying a malfunction indicator light or other visually perceptible output, setting a diagnostic fault code perceptible by use of an OBD scanner, transmitting a fault indication to a remote system such as a maintenance database, or combinations of these and other fault indication techniques as would occur to one of skill in the art with the benefit of the present disclosure.

As noted above, certain embodiments herein may utilize output metrics and output metric statistics pertaining to the frequency content of the output of an EMP sensor. Certain forms of such embodiments may utilize cycle frequency information. The cycle frequency is correlated with the engine speed and in four-stroke engines may be defined as one half of the rotational frequency of the engine. For example, if the engine revolution frequency is 120 rpm (2 rotations per second), the cycle frequency is one rotation per second or 1 Hz. Hence, the changes of cycle frequency correlate with the changes in engine speed. In engines with multiple cylinders, each cycle includes a stroke for each cylinder with different cylinders having offset phases.

Figure 3:
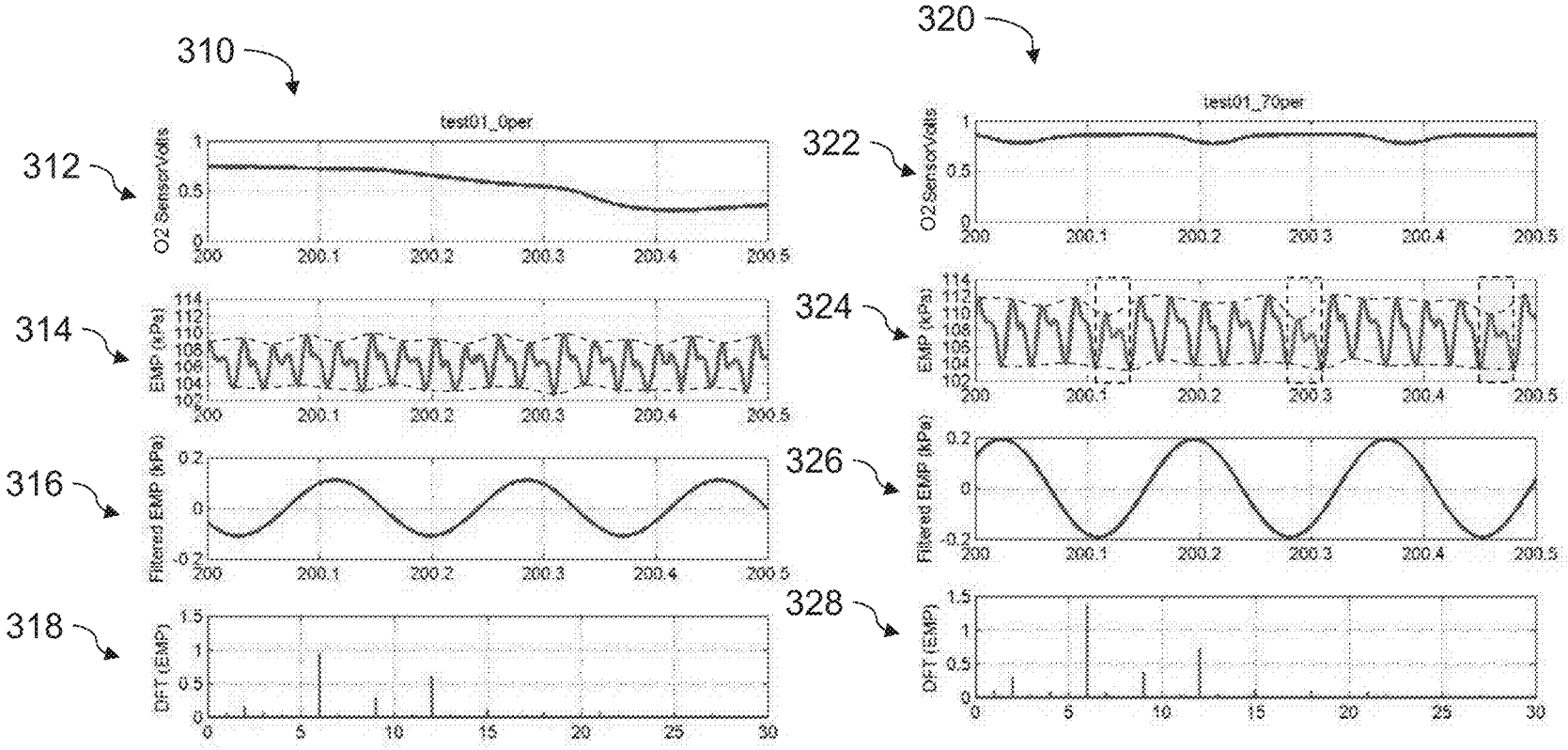
FIGS. 3-12 depict graphs illustrating certain aspects of several diagnostic techniques which may be utilized in connection with a diagnostic process such as the exemplary diagnostic process of FIG. 2.
Figure 4:
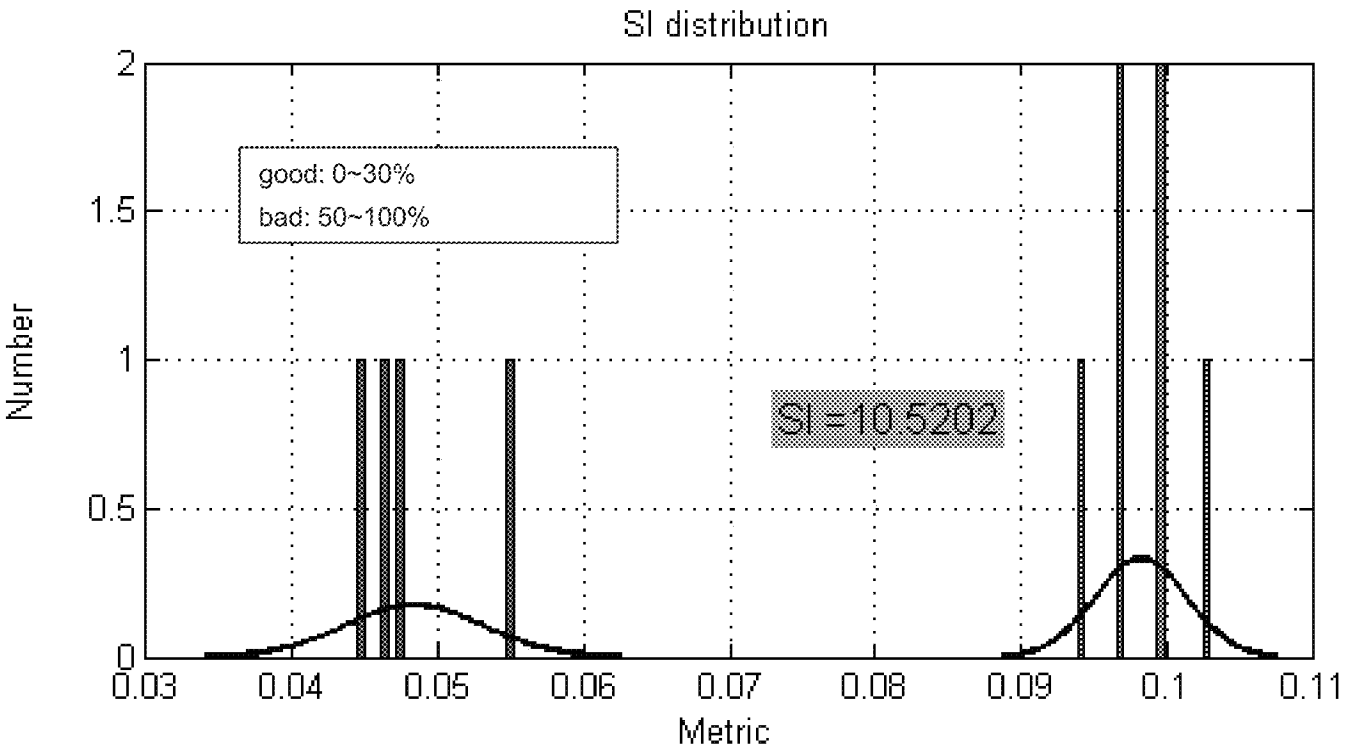

During operation of an engine such as engine 102, that exhaust manifold pressure may be correlated to a lambda signal in a particular cylinder. To explain the underlying theory, an exemplary exhaust manifold pressure dynamics model provides that:

$$\dot{p}_{em} = \frac{RT_{em}}{V_{em}}(\dot{m}_{exh} - \dot{m}_{egr} - \dot{m}_t - \dot{m}_{wg})$$

where $\dot{p}_{em}$ is the exhaust manifold pressure, R is the ideal or universal gas constant, $T_{em}$ is the exhaust manifold temperature, $V_{em}$ is the exhaust manifold volume, $\dot{m}_{exh}$ is the exhaust flow, $\dot{m}_{egr}$ is the EGR flow, $\dot{m}_t$ is the flow through a turbine of a turbocharger and $\dot{m}_{wg}$ is the flow through a wastegate of a turbocharger (where present). The exhaust flow:

$$\dot{m}_{exh} = A_{ev}\frac{p_c}{\sqrt{RT_c}}\Psi\left(\frac{p_{em}}{p_c}\right)$$

is therefore a function of the cylinder pressure, and the cylinder pressure:

$$\dot{p}_c = \frac{\gamma^{-1}}{V_c}(\dot{Q}_{comb} - \dot{Q}_{ht}) - \frac{\gamma}{V_c}p_c\dot{V}_c$$

in turn, is a function of lambda, since the combustion heat release rate $\dot{Q}_{comb}$ is a function of lambda. Hence, the exhaust flow is correlated to lambda for each particular cylinder. Accordingly, if there is an AFR imbalance, there is cycle frequency content in the lambda signal, and the AFR imbalance will be present in the exhaust flow in the exhaust manifold. Further, if the AFR imbalance is present in the exhaust gas flow, it would also be present in the EMP sensor signal. FIGS. 3-4 illustrate an exemplary AFR imbalance diagnostic technique which may be utilized in connection with the system of FIG. 1 and/or the controls of FIG. 2.

With reference to FIG. 3 there are illustrated two sets of graphs 310, 320 depicting EMP sensor signal output when the engine is an idling condition. Graphs 310 illustrate operating conditions in which there is no AFR imbalance between the cylinders of the example spark-ignition engine 100. Graphs 320 illustrate operating conditions in which there is an AFR imbalance between the cylinders of the example spark-ignition engine 100. Graphs 312 and 322 depict the voltage output of a switching oxygen sensor provided as sensor 142 or 142*a* as a function of time. It shall be appreciated that other types of sensors and sensor outputs may be utilized, for example, a wideband oxygen sensor which provides an output current signal may be utilized in some embodiments. Graphs 314 and 324 depict exhaust manifold pressure (EMP) as a function of time. Graphs 316 and 326 depict filtered exhaust manifold pressure as a function of time. Graphs 318 and 328 depict a transform of the graphs 314 and 324 to the frequency domain. Graph 314 illustrates a natural oscillation cycle of the EMP sensor signal. In contrast, graph 324 illustrates regions indicated with dashed rectangles where there is non-uniformity that depict the occurrences of AFR imbalance. Furthermore, in comparing graphs 318 and 328, it can be seen that the system with AFR imbalance has greater cycle frequency content, e.g., the magnitude of the signal at about 6 Hz is greater in graph 328 than in graph 318.

With reference to FIG. 4, there is illustrated an example separation index (SI) distribution. On the horizontal axis, an example metric statistic is plotted. As a non-limiting example, the metric statistic may be the magnitude of the frequency content of the EMP sensor signal at the cycle frequency. As a non-limiting example, the metric statistic of 0.07 may be set as an example predetermined threshold value (as discussed with reference to conditional 214 above). For example, the metric statistic of 0.07 identifies that an AFR imbalance condition occurs in values above the threshold value and that no AFR imbalance occurs in metric statistics below it. As shown on the distribution, the metric statistics from 0.09-0.11 have higher magnitudes (i.e., as depicted as "Number" on the vertical axis), and therefore, represent having more content at the cycle frequency. From this example it can be seen that when an AFR imbalance is present, the EMP sensor signal has a greater frequency content at the cycle frequency. As such, the frequency component of the EMP sensor signal output from the EMP sensor may be used to detect AFR imbalance. By extracting and monitoring the frequency component of the EMP sensor signal at the cycle frequency and/or extracting and monitoring one or more harmonics of the cycle frequency, a first diagnostic may be performed that determines whether one or more cylinders of a multi-cylinder engine, such as engine 102, are running at a different AFR than the average AFR.

Figure 5:
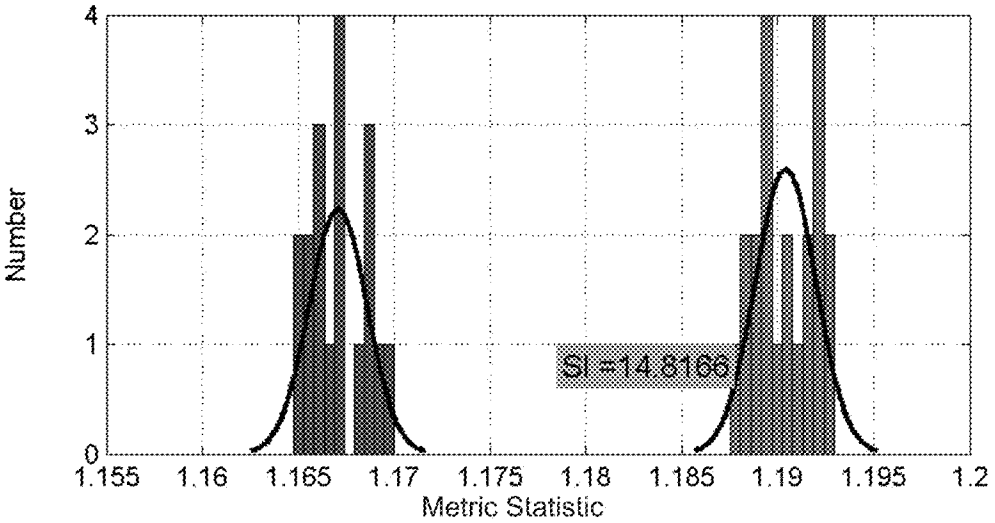
Figure 5:
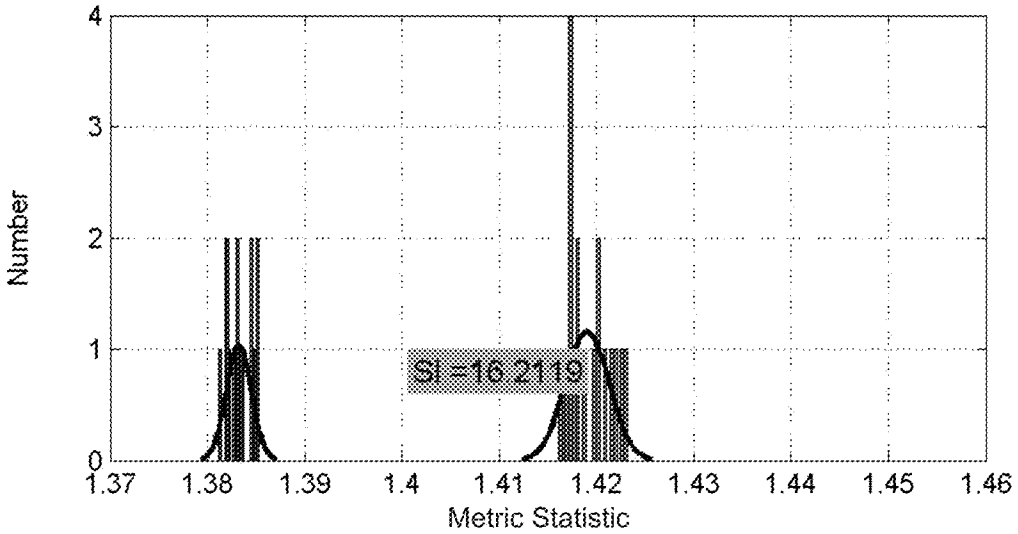

With reference to FIG. 5 there is illustrated graphs 510 and 520 which depict example distributions produced utilizing a group energy signal processing technique to extract a cycle frequency component from an EMP sensor signal. Further details of the group energy signal processing technique are set forth in International Application No. PCT/US17/64010 and U.S. Application No. 62/428,656 entitled Air-Fuel Ratio Imbalance Diagnostics Using Spectral Analysis Methods the disclosure of which are incorporated herein by reference. The distributions of the left-hand side of graphs 510 and 520 depict results where no AFR imbalance is present in the cylinders of an engine such as engine 102. The distributions of the right-hand side of graphs 510 and 520 depict results where an AFR imbalance is present in the cylinders of an engine such as engine 102. For graph 510, the group energy method is used with regard to the analysis of a 50 Hz sampling of the EMP sensor signal. In this particular implementation, a group energy metric is calculated based on the exhaust manifold pressure and the metric is sampled at a 50 Hz sample, and the resulting metric samples are resolved over a time interval in the time domain. In graph 510, the "Number" of resulting metric samples are depicted as a function of a computed metric statistic. For graph 520, the group energy method is used with regard to the analysis of a 0.5 TDC (top dead center) sampling of the EMP sensor signal. Accordingly, a group energy metric is calculated based on the exhaust manifold pressure and the metric is at a 0.5 of TDC sample rate, and the resulting metric samples are resolved in the frequency domain. In graph 520, the "Number" of resulting metric samples are depicted as a function of another computed metric statistic. A threshold may be defined (according to operation 212) intermediate the left-hand distribution and the right-hand distribution and may be used to judge whether the sampled data indicates the existence of a cylinder AFR imbalance condition. According to the non-limiting example data set as shown in graph 510, a predetermined threshold value may be set at 1.18 to delineate the portion of metric statistics that identify an AFR imbalance condition. The metric statistic of 1.18 identifies that an AFR imbalance condition occurs in values above the threshold value and that no AFR imbalance occurs in metric statistics below it. As shown on the example distribution in graph 510, the metric statistics at approximately 1.19 have higher magnitudes (i.e., as depicted as "Number" on the vertical axis), and, therefore, represent having more content at the cycle frequency. Once the threshold is established, the computed output metric statistic is compared to the predetermined threshold value to determine whether AFR imbalance is present in the spark-ignition engine 100 under test.

Figure 6:
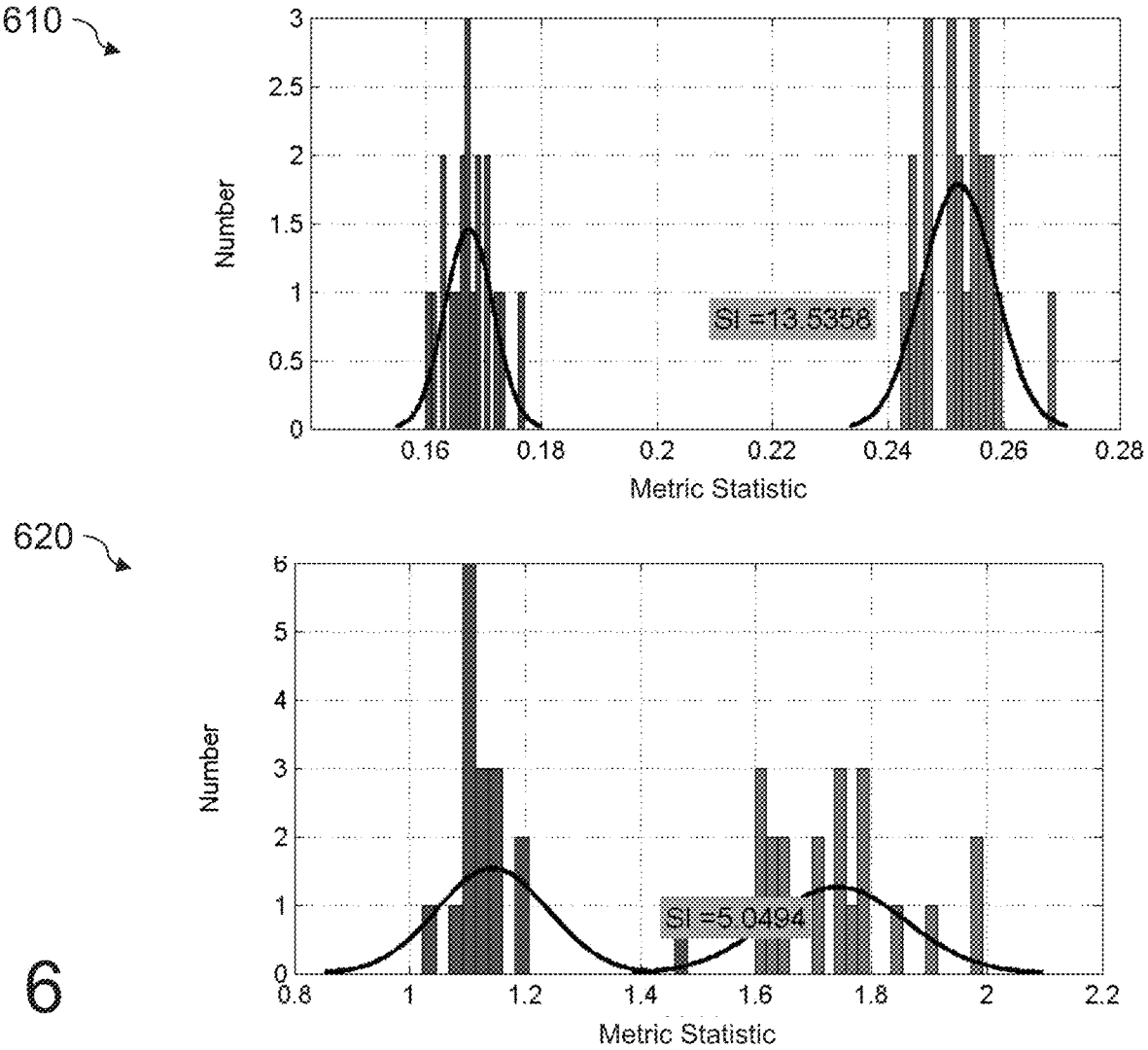

With reference to FIG. 6, there is illustrated graphs 610 and 620 which depict example frequency distributions produced utilizing an autoregressive (AR) model method processing technique to extract a cycle frequency component from an EMP sensor signal. Further details of the AR method are set forth in the above-referenced and incorporated International Application No. PCT/US17/64010 and U.S. Application No. 62/428,656. For graph 610, the AR model method is used with regard to the analysis of a 50 Hz sampling of the EMP sensor signal. In this particular implementation, an AR metric is calculated based on the exhaust manifold pressure and the metric is sampled at a 50 Hz sample, and the resulting metric samples are resolved over a time interval in the time domain. In graph 610, the "Number" of resulting metric samples are depicted as a function of a computed metric statistic ("Metric Statistic"). For graph 620, the AR method is used with regard to the analysis of a 0.5 TDC (top dead center) sampling of the EMP sensor signal. Accordingly, an AR metric is calculated based on the exhaust manifold pressure and the metric is at a 0.5 of TDC sample rate, and the resulting metric samples are resolved in the frequency domain. In graph 620, the "Number" of resulting metric samples are depicted as a function of another computed metric statistic. A threshold may be defined (according to operation 212) intermediate the left-hand distribution and the right-hand distribution and may be used to judge whether the sampled data indicates the existence of a cylinder AFR imbalance condition. As an example, according to the non-limiting data set as shown in graph 610, a predetermined threshold value may be set at 0.22 to delineate the portion of metric statistics that identify an AFR imbalance condition. The metric statistic of 0.22 identifies that an AFR imbalance condition occurs in values above the threshold value and that no AFR imbalance occurs in metric statistics below it. As shown on the example distribution in graph 610, the metric statistics at approximately 0.25 have higher magnitudes (i.e., as depicted as "Number" on the vertical axis), and, therefore, represent having more content at the cycle frequency. Once the threshold is established, the computed output metric statistic is compared to the predetermined threshold value to determine whether AFR imbalance is present in the spark-ignition engine 100 under test.

Figure 7:
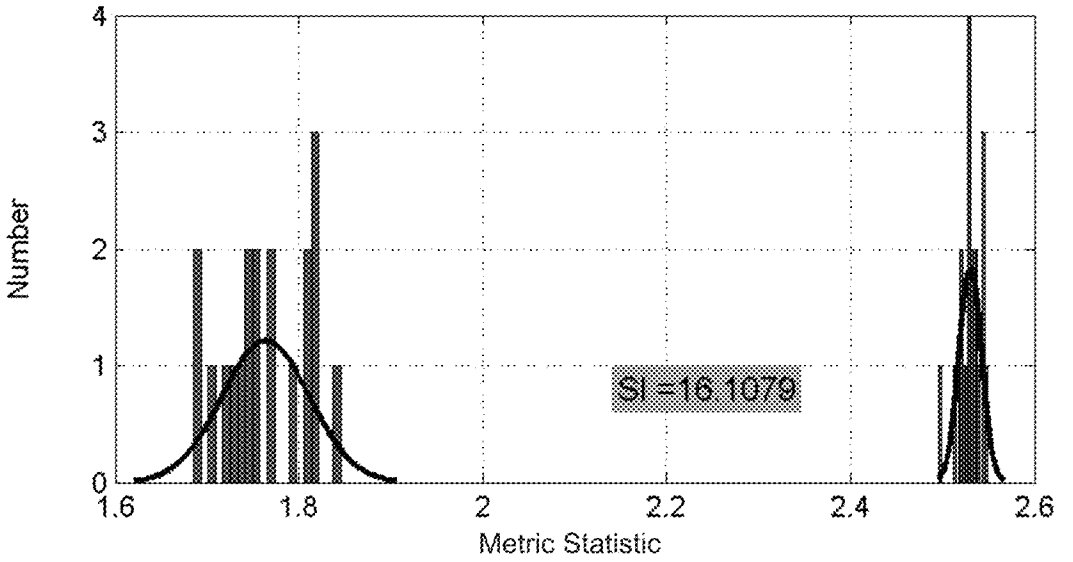
Figure 7:
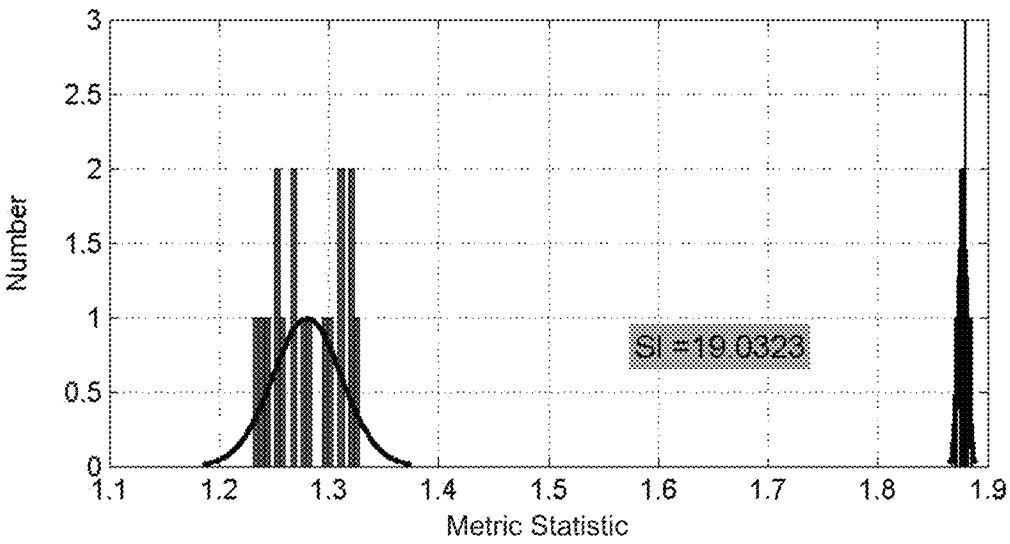

With reference to FIG. 7 there is illustrated graphs 710 and 720 which depict example frequency distributions produced utilizing a notch filter method processing technique to extract a cycle frequency component from an EMP sensor signal. For graph 710, the notch filter method is used with regard to the analysis of a 50 Hz sampling of the EMP sensor signal. In this particular implementation, a notch filter metric is calculated based on the exhaust manifold pressure and the metric is sampled at a 50 Hz sample, and the resulting metric samples are resolved over a time interval in the time domain. In graph 710, the "Number" of resulting metric samples are depicted as a function of a computed metric statistic. For graph 720, the notch filter method is used with regard to the analysis of a 0.5 TDC (top dead center) sampling of the EMP sensor signal. Accordingly, a notch filter metric is calculated based on the exhaust manifold pressure and the metric is at a 0.5 of TDC sample rate, and the resulting metric samples are resolved in the frequency domain. In graph 720, the "Number" of resulting metric samples are depicted as a function of another computed metric statistic. A threshold may be defined (according to operation 212) intermediate the left-hand distribution and the right-hand distribution and may be used to judge whether the sampled data indicates the existence of a cylinder AFR imbalance condition. As an example, according to the non-limiting data set as shown in graph 710, a predetermined threshold value may be set at 2.2 to delineate the portion of metric statistics that identify an AFR imbalance condition. The metric statistic of 2.2 identifies that an AFR imbalance condition occurs in values above the threshold value and that no AFR imbalance occurs in metric statistics below it. As shown on the example distribution in graph 710, the metric statistics at approximately 2.5 have higher magnitudes (i.e., as depicted as "Number" on the vertical axis), and, therefore, represent having more content at the cycle frequency. Once the threshold is established, the computed output metric statistic is compared to the predetermined threshold value to determine whether AFR imbalance is present in the spark-ignition engine 100 under test.

Figure 8:
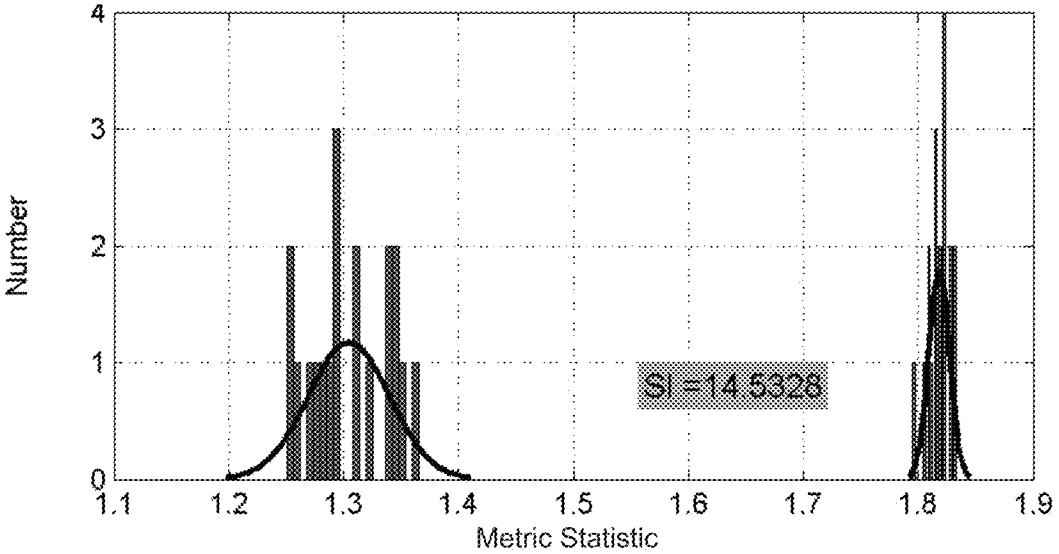
Figure 8:
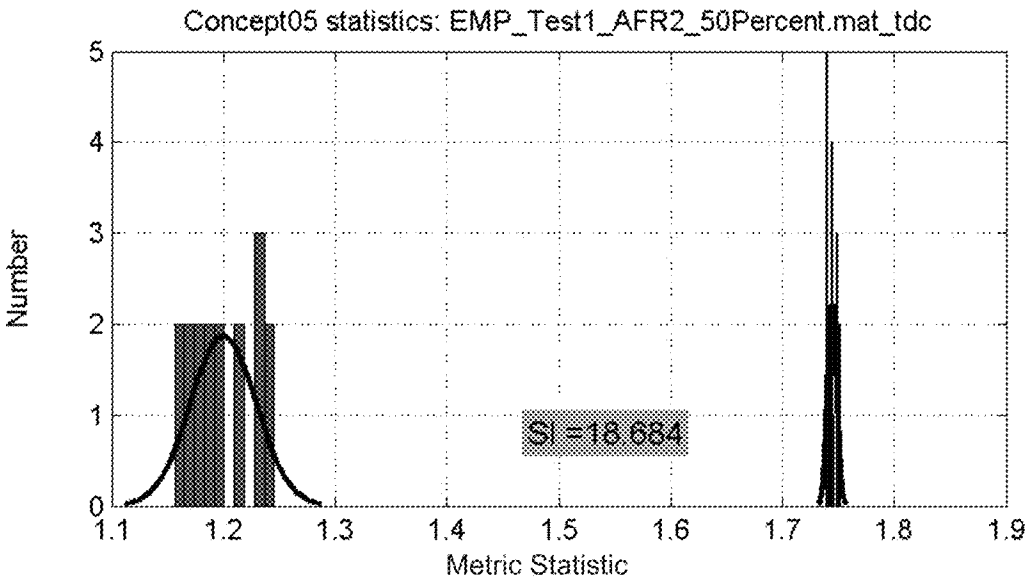

With reference to FIG. 8, there is illustrated graphs 810 and 820 which depict example frequency distributions produced utilizing a Kalman filter method processing technique to extract a cycle frequency component from an EMP sensor signal. For graph 810, the Kalman filter method is used with regard to the analysis of a 50 Hz sampling of the EMP sensor signal. In this particular implementation, a Kalman filter metric is calculated based on the exhaust manifold pressure and the metric is sampled at a 50 Hz sample, and the resulting metric samples are resolved over a time interval in the time domain. In graph 810, the "Number" of resulting metric samples are depicted as a function of a computed metric statistic. For graph 820, the Kalman filter method is used with regard to the analysis of a 0.5 TDC (top dead center) sampling of the EMP sensor signal. Accordingly, a Kalman filter metric is calculated based on the exhaust manifold pressure and the metric is at a 0.5 of TDC sample rate, and the resulting metric samples are resolved in the frequency domain. In graph 820, the "Number" of resulting metric samples are depicted as a function of another computed metric statistic. A threshold may be defined (according to operation 212) intermediate the left-hand distribution and the right-hand distribution and may be used to judge whether the sampled data indicates the existence of a cylinder AFR imbalance condition. As an example, according to the non-limiting data set as shown in graph 810, a predetermined threshold value may be set at 1.6 to delineate the portion of metric statistics that identify an AFR imbalance condition. The metric statistic of 1.6 identifies that an AFR imbalance condition occurs in values above the threshold value and that no AFR imbalance occurs in metric statistics below it. As shown on the example distribution in graph 810, the metric statistics at approximately 1.8 have higher magnitudes (i.e., as depicted as "Number" on the vertical axis), and, therefore, represent having more content at the cycle frequency. Once the threshold is established, the computed output metric statistic is compared to the predetermined threshold value to determine whether AFR imbalance is present in the spark-ignition engine 100 under test.

Figure 9:
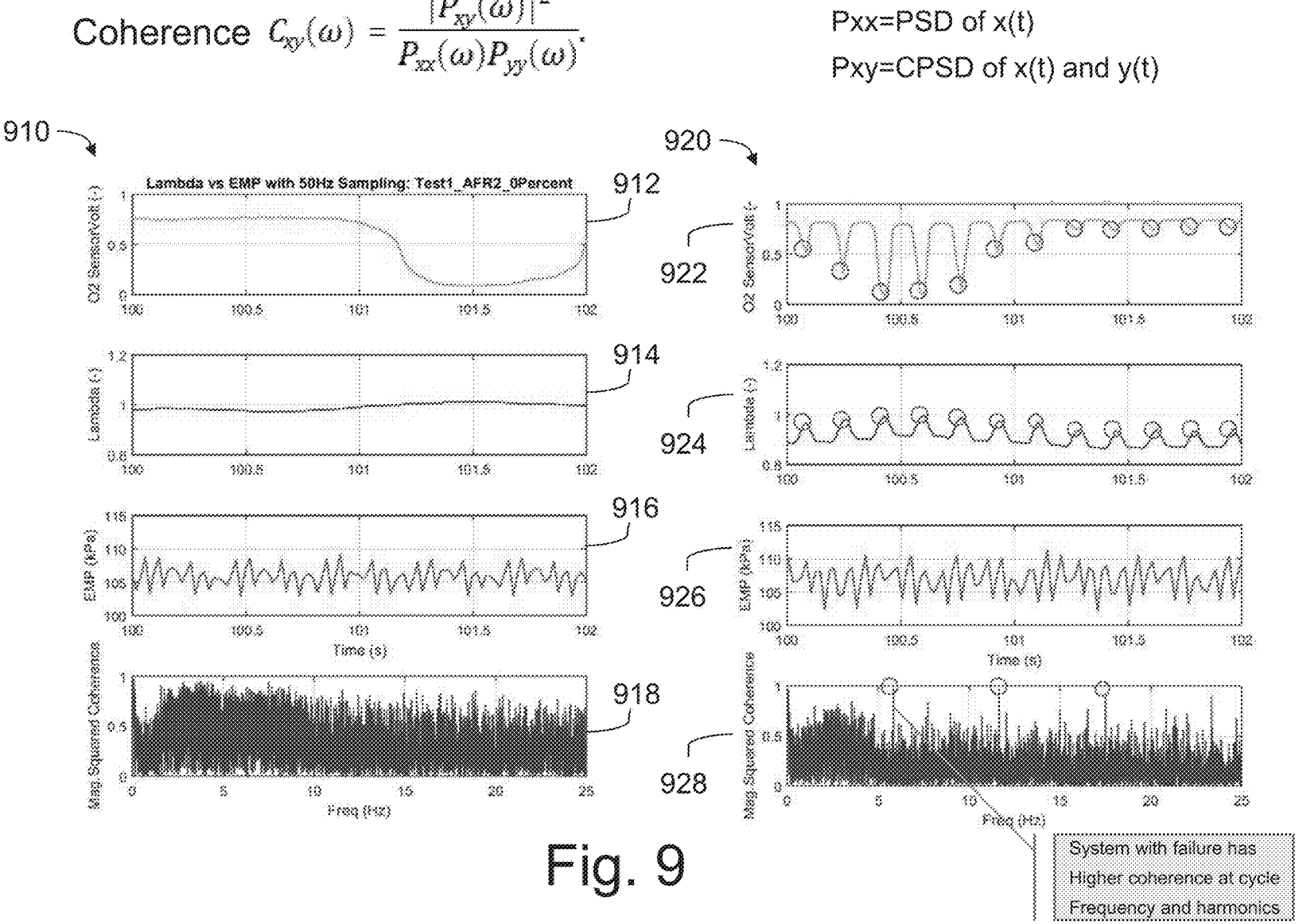

With reference to FIG. 9, there are illustrated two sets of graphs 910, 920 depicting coherence between the output signals of the exhaust oxygen sensor or lambda sensor 142 or 142*a* and the EMP sensor 144 or 144*a* in the system of FIG. 1. As explained in above paragraphs, if there is an AFR imbalance (e.g., when one particular cylinder is running at a different lambda), there is cycle frequency content in the lambda signal, and the AFR imbalance will be present in the EMP sensor signal. Hence, the lambda sensor signal and EMP sensor signal are correlated at the cycle frequency and/or its harmonics. As such, the coherence of the EMP sensor signal in conjunction with the lambda signal may be used to detect AFR imbalance. Graphs 910 illustrate operating conditions in which there is no AFR imbalance between the cylinders of the example spark-ignition engine 100. Graphs 920 illustrate operating conditions in which there is an AFR imbalance between the cylinders of the example spark-ignition engine 100. Graphs 912 and 922 depict an example oxygen sensor voltage signal (e.g., from the switching sensor voltage) over a particular time interval. Graphs 914, 924 depict the lambda sensor signal over the time interval and graphs 916, 926 depict the EMP sensor signal over the same time interval. Graphs 918, 928 illustrate the coherence between the lambda sensor signal and the EMP sensor signal over a frequency range. As depicted in graph 918, and in contrast with graph 928, different coherence metric samples have distinct peaks (e.g., higher coherence values) at the cycle frequency and its harmonics. Accordingly, a diagnostic may be performed by a comparison of the EMP sensor signal and the lambda signal at the cycle frequency (and/or the harmonics of the cycle frequency) to generate coherence data. Based on the generated coherence data, metric samples may be obtained and from which metric statistics may be computed. From the present exemplary embodiment is shall be appreciated that the coherence value may itself be utilized as a diagnostic statistic, for example, a plurality of coherence data samples may be selected to determine a metric statistic.

Figure 10:
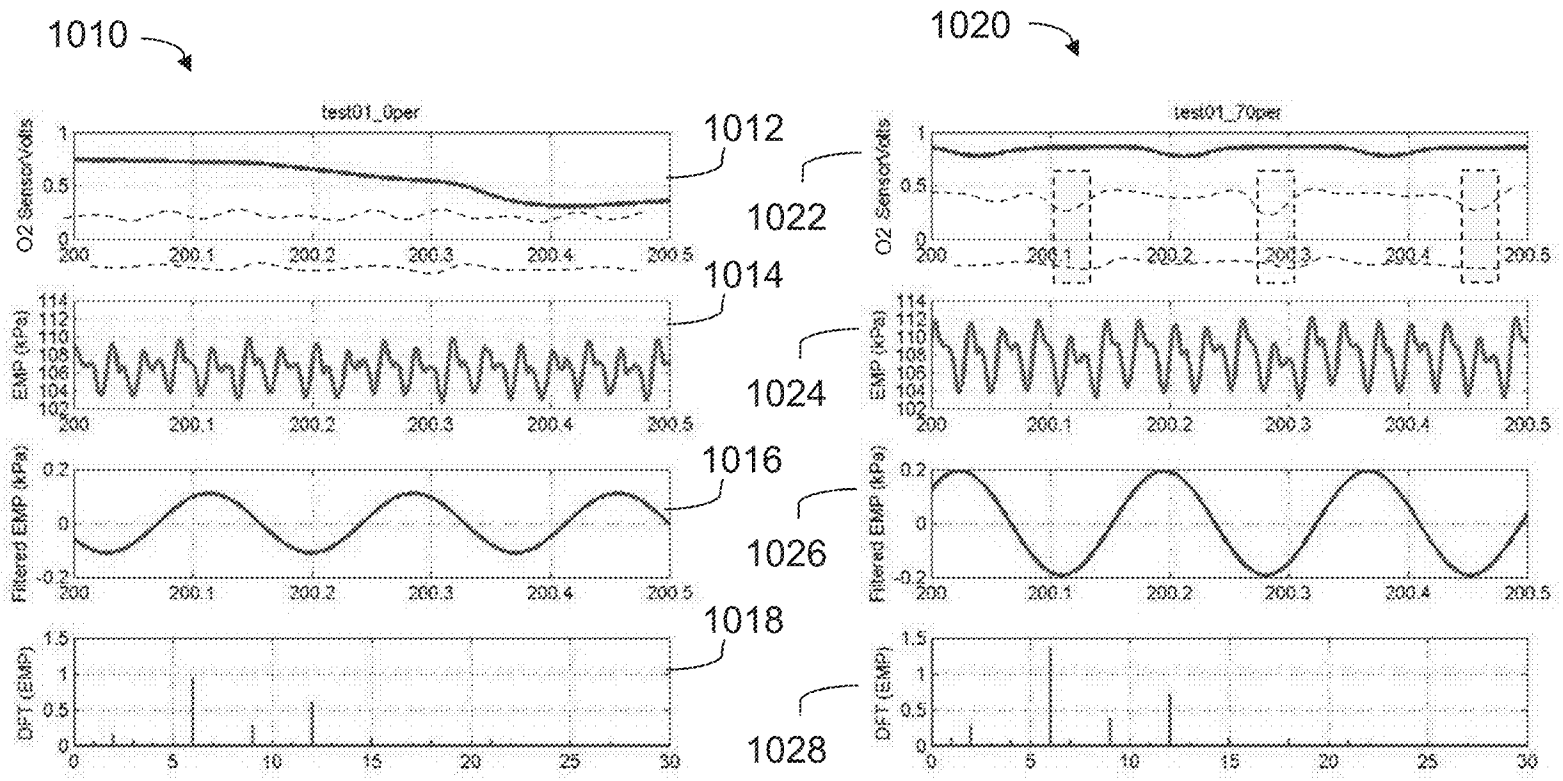

With reference to FIG. 10, there is illustrated two sets of graphs 1010, 1020 depicting EMP sensor signal output when the engine is an idling condition. Similar to Graphs 310, 320 in FIG. 3, the two sets of Graphs 1010, 1020 depict EMP sensor signal output when the engine is an idling condition. Graphs 1010 illustrate operating conditions in which there is no AFR imbalance between the cylinders of the example spark-ignition engine 100. Graphs 1020 illustrate operating conditions in which there is an AFR imbalance between the cylinders of the example spark-ignition engine 100. Graphs 1012 and 1022 depict the voltage output of a switching oxygen sensor provided as sensor 142 or 142*a* as a function of time. As noted above other types of sensors and sensor outputs may be utilized, for example, a wideband oxygen sensor which provides an output current signal may be utilized in some embodiments. Graphs 1014 and 1024 depict exhaust manifold pressure (EMP) as a function of time. Graph 1014 illustrates an EMP signal with a uniform repeating pattern having a natural oscillation cycle and similar peaks. From this observance, it can be inferred that each of the cylinders (of the spark-ignition engine 100) are operating without imbalance. In contrast, graph 1024 illustrates portions of non-uniformity and uneven peaks (which have been highlighted in the shaded dashed-line box). As described above, that non-uniformity in the EMP sensor signal results from the uneven AFRs of multiple cylinders. Accordingly, a non-uniformity-based metric from the EMP sensor signal may also be utilized to detect AFR imbalance. In particular implementations, the EMP non-uniformity metric may be computed from relative maxima and minima data obtained and stored in memory for a preceding K (integer) engine cycles. To describe the underlying theory, this calculation involves averaging the non-uniformity quantity that is computed over the K cycles. The choice of K depends upon the particular engine control application.

Figure 11:
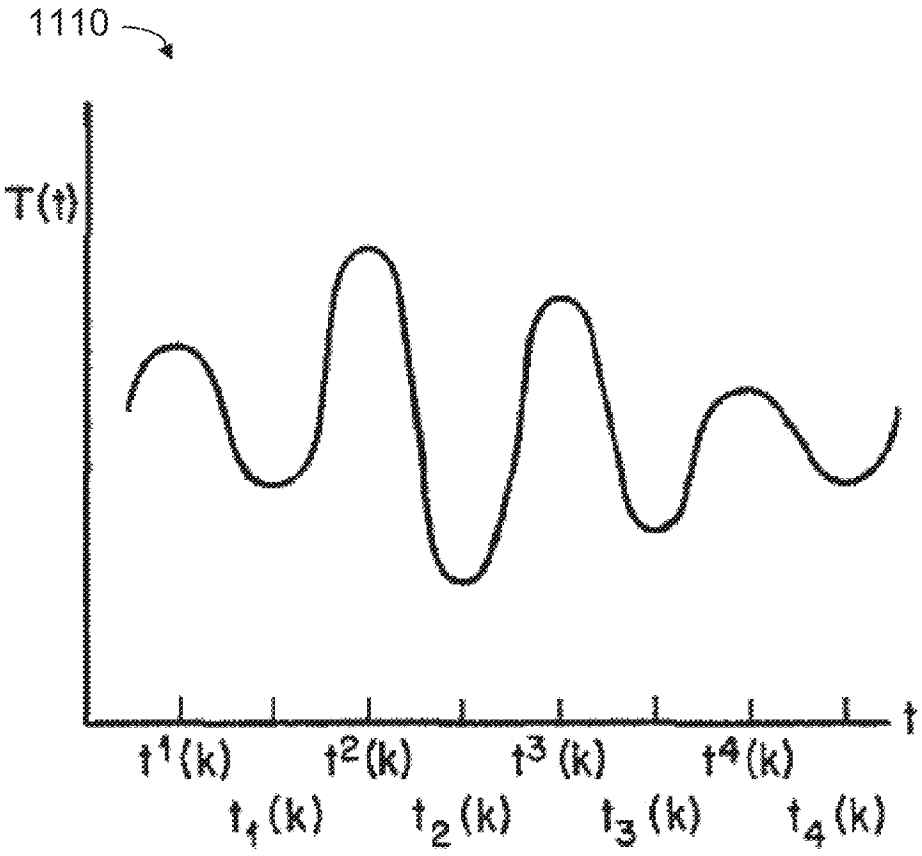

With reference to FIG. 11, there is illustrated a graph 1110 depicting a torque signal T as a function of time t. As illustrated in FIG. 11 and considering the kth engine cycle (i.e., consisting of two complete revolutions), for an N cylinder engine, there will be N relative maxima and N relative minima of cyclically varying signals such as torque or EMP sensor signals. The relative maxima and minima for the kth cycle are ordered with superscripts n as follows.

$T^n(k)$=nth relative maximum n=1, 2 . . . N $T_n(k)$=nth relative minimum

It is convenient to define a 2N dimensional vector T(k) having components $$T(k)=[T^1(k), T_1(k), T^2(k) \ldots T_N(k)]$$

where the prime indicates transpose. The non-uniformity information signal or metric is derived from manipulations of this vector. The corresponding computations are readily performed by a digital computer.

The mean value of the elements in the 2N dimensional vector per cycle is denoted T(k) and is given by the $l_1$ norm $$T(k) = \frac{1}{2N}\|T(k)\|_1 = \frac{1}{2N}\sum_{n=1}^{N}[|T^n(k)| + |T_n(k)|]$$

From this quantity, a deviation vector which is denoted by τ(k) is defined as $$\tau(k)=T(k)-T(k)u$$

where u is a 2N dimensional unit column vector. The components of the vector τ(k) represent the deviation of the N relative maxima and N relative minima from the cycle average T(k).

Next a non-uniformity vector n(k) is defined of the same vector length:

$$\underline{n}(k) = \underline{\tau}(k) - \frac{e\|\tau(k)\|_1}{2N}$$

where e is a 1×2N vector $$e'=[1, -1, \ldots 1, -1]$$

The two actual non-uniformity metrics which are computed per cycle are the $l_1$ and $l_2$ norms for n(k):

$$n_1(k)=\|n(k)\|_1$$

$$n_2(k)=\|n(k)\|_2$$

Accordingly, in particular implementations, $n_1(k)=\|\underline{n}(k)\|_1$ or $n_2(k)=\|\underline{n}(k)\|_2$ may be used as non-uniformity metrics.

Figure 12:
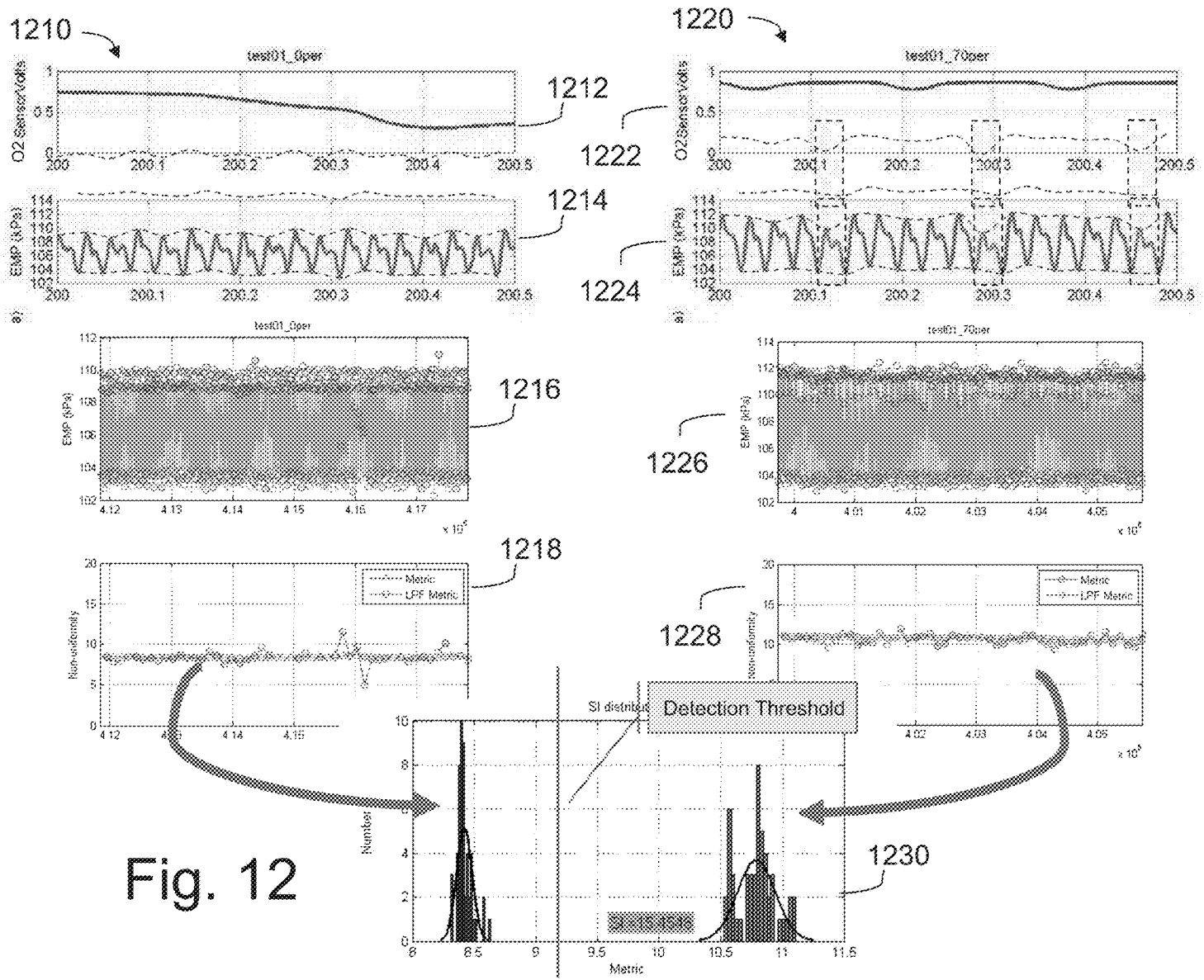

With reference to FIG. 12, there is illustrated two sets of Graphs 1210, 1220 depicting example distributions produced utilizing a non-uniformity metric as described above to compute the non-uniformity from an EMP sensor signal. Graphs 1210 illustrate operating conditions in which there is no AFR imbalance between the cylinders of the example spark-ignition engine 100. Graphs 1220 illustrate operating conditions in which there is an AFR imbalance between the cylinders of the example spark-ignition engine 100. In this particular implementation, non-uniformity metrics are calculated based on $n_1(k)=\|\underline{n}(k)\|_1$ or $n_2(k)=\|\underline{n}(k)\|_2$ using the EMP sensor signal. Graphs 1212 and 1222 both depict the relative maxima and minima of the EMP sensor samples. Graphs 1214 and 1224 depict a computed non-uniformity metric over a certain time interval. In Graph 1230, the "Number" of resulting non-uniformity occurrences are depicted as a function of the non-uniformity metric. A threshold may be defined (according to operation 212) intermediate the left-hand distribution and the right-hand distribution and may be used to judge whether the sampled data indicates the existence of a cylinder AFR imbalance condition. As an example, according to the non-limiting data set as shown in graph 1230, a predetermined threshold value may be set at 9.25 to delineate the portion of non-uniformity metric that identifies an AFR imbalance condition. The metric of 9.25 identifies that an AFR imbalance condition occurs in values above the threshold value and that no AFR imbalance occurs in metric below it. As shown on the example distribution in Graph 1230, the metric values at approximately 10.75 have higher magnitudes (i.e., as depicted as "Number" on the vertical axis), and, therefore, represent having more non-uniformity. Once the threshold is established, the computed non-uniformity metric is compared to the predetermined threshold value to determine whether AFR imbalance is present in the spark-ignition engine 100 under test. From the present example, it shall be appreciated that a metric statistic may be calculated by taking values of the metric itself.

While illustrative embodiments of the disclosure have been illustrated and described in detail in the drawings and foregoing description, the same is to be considered as illustrative and not restrictive in character, it being understood that only certain exemplary embodiments have been shown and described and that all changes and modifications that come within the spirit of the claimed inventions are desired to be protected. It should be understood that while the use of words such as preferable, preferably, preferred or more preferred utilized in the description above indicates that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A system comprising:

a multi-cylinder engine structured to combust a charge mixture and to output exhaust;

an electronic control system structured to control operation of the engine system;

an exhaust manifold; and an exhaust manifold pressure (EMP) sensor structured to provide data to the electronic control system;

wherein the electronic control system is configured to performing an air-fuel ratio (AFR) imbalance diagnostic, the AFR imbalance diagnostic comprising the acts of:

processing the data of the EMP sensor to provide at least one output metric sample, determining an output metric statistic using the at least one output metric sample, and evaluating the output metric statistic relative to one or more predetermined criteria to identify an inter-cylinder AFR imbalance condition; and modifying operation of the system in response to the inter-cylinder AFR imbalance condition.

2. The system of claim 1, wherein the AFR imbalance diagnostic further comprises monitoring frequency content of an EMP sensor signal to generate EMP data, wherein the cycle frequency is one half of a rotational frequency of the engine and the monitoring comprises monitoring at one or more of the cycle frequency and a harmonic of the cycle frequency.

3. The system of claim 2, wherein the act of processing the data to provide the at least one output metric sample includes determining the at least one output metric sample based on the data extracted from the frequency component of the EMP sensor signal at the cycle frequency.

4. The system of claim 2, wherein the frequency component of the EMP sensor signal is extracted using at least one of an autoregressive model, a Notch filter, and a Kalman filter.

5. The system of claim 1, wherein the AFR imbalance diagnostic further comprises comparing an exhaust oxygen sensor signal and an EMP sensor signal at a cycle frequency to generate coherence data, and wherein the cycle frequency is one half of a rotational frequency, and the act of processing the data to provide the at least one output metric sample includes determining the at least one output metric sample based on the generated coherence data.

6. The system of claim 1, wherein the AFR imbalance diagnostic further comprises evaluating an EMP signal output over at least one engine cycle to generate the data, and wherein the cycle frequency is one half of a rotational frequency.

7. An apparatus comprising:

a non-transitory memory medium configured to store instructions executable by an electronic controller to perform an AFR imbalance diagnostic including the acts of operating a multi-cylinder engine including an exhaust manifold pressure (EMP) sensor, processing data received from the EMP sensor to provide at least one output metric sample, determining an output metric statistic in response to the at least one output metric sample, evaluating the output metric statistic relative to one or more predetermined criteria to identify an inter-cylinder AFR imbalance condition, and commanding modified operation of the engine in response to the inter-cylinder AFR imbalance condition.

8. The apparatus of claim 7, wherein the act of evaluating the output metric statistic relative to one or more predetermined criteria includes a comparison of the output metric statistic with respect to a predetermined threshold value.

9. The apparatus of claim 7, wherein the AFR imbalance diagnostic further comprises evaluating an EMP signal output over at least one engine cycle to generate the data, and wherein the cycle frequency is one half of a rotational frequency.

10. The apparatus of claim of claim 9, wherein act of processing the data to provide the at least one output metric sample includes determining at least one output non-uniformity metric sample based on the generated non-uniformity data, the EMP sensor signal output is at the cycle frequency or a harmonic of the cycle frequency, and the data of the EMP sensor is processed in response to evaluating whether enable conditions are satisfied.

11. A method comprising:

operating an engine system including a multi-cylinder engine, an exhaust manifold, an electronic control system structured to control operation of the engine system, and an exhaust manifold pressure (EMP) sensor structured to provide data to the electronic control system;

performing an air-fuel ratio (AFR) imbalance diagnostic with the electronic control system, the AFR imbalance diagnostic comprising the acts of:

processing the data from the EMP sensor to provide at least one output metric sample, determining an output metric statistic in response to the at least one output metric sample, and evaluating the output metric statistic relative to one or more predetermined criteria to identify an inter-cylinder AFR imbalance condition; and performing a corrective control operation effective to modify operation of the system in response to the inter-cylinder AFR imbalance condition.

12. The method of claim 11, wherein the AFR imbalance diagnostic further comprises monitoring frequency content of an EMP sensor signal to generate EMP data, wherein the cycle frequency is one half of a rotational frequency of the engine and the monitoring comprises monitoring at one or more of the cycle frequency and a harmonic of the cycle frequency.

13. The method of claim 12, wherein the act of processing the data to provide the at least one output metric sample includes determining the at least one output metric sample based on the data extracted from the frequency component of the EMP sensor signal at the cycle frequency.

14. The method of claim 13, wherein the frequency component of the EMP sensor signal is extracted using a group energy technique.

15. The method of claim 12, wherein the frequency component of the EMP sensor signal is extracted using at least one of an autoregressive model, a Notch filter, and a Kalman filter.

16. The method of claim 11, wherein evaluating the output metric statistic relative to one or more predetermined criteria includes a comparison of the output metric statistic with respect to a predetermined threshold value.

17. The method of claim 11, wherein the AFR imbalance diagnostic further comprises comparing an exhaust oxygen sensor signal and an EMP sensor signal at a cycle frequency to generate coherence data, and wherein the cycle frequency is one half of a rotational frequency, and the act of processing the data to provide the at least one output metric sample includes determining the at least one output metric sample based on the generated coherence data.

18. The method of claim 11, wherein the AFR imbalance diagnostic further comprises evaluating an EMP signal output over at least one engine cycle to generate the data, and wherein the cycle frequency is one half of a rotational frequency.

19. The method of claim 18, wherein processing the data to provide the at least one output metric sample includes determining at least one output non-uniformity metric sample based on the generated non-uniformity data, the EMP sensor signal output is at the cycle frequency or a harmonic of the cycle frequency, and the data of the EMP sensor is processed in response to evaluating whether enable conditions are satisfied.

20. The method of claim 11, wherein the data of the EMP sensor is processed in in combination with data of a lambda sensor to provide at least one output metric sample.

* * * * *